US008135163B2

(12) United States Patent
Blanchard et al.

(10) Patent No.: US 8,135,163 B2
(45) Date of Patent: Mar. 13, 2012

(54) BALANCED ARMATURE WITH ACOUSTIC LOW PASS FILTER

(75) Inventors: Mark Alan Blanchard, Lebanon, IN (US); Bradley Carl Geswein, Plainfield, IN (US); Eric A. Hruza, Plymouth, MN (US); Onno Geschiere, Amsterdam (NL)

(73) Assignee: Klipsch Group, Inc., Indianapolis, IN (US)

( * ) Notice: Subject to any disclaimer, the term of this patent is extended or adjusted under 35 U.S.C. 154(b) by 1198 days.

(21) Appl. No.: 11/897,380

(22) Filed: Aug. 30, 2007

(65) Prior Publication Data

US 2009/0060245 A1 Mar. 5, 2009

(51) Int. Cl.
*H04R 1/02* (2006.01)
*H04R 1/20* (2006.01)
*H04R 25/00* (2006.01)

(52) U.S. Cl. ..... 381/418; 381/349; 381/417

(58) Field of Classification Search ..... 381/345, 381/354, 380, 151, 328, 92, 418, 417, 322, 381/342; 181/129, 135
See application file for complete search history.

(56) References Cited

U.S. PATENT DOCUMENTS

| | | | | |
|---|---|---|---|---|
| 2,430,229 | A | | 11/1947 | Kelsey |
| 2,487,038 | A | | 11/1949 | Baum |
| 3,080,011 | A | | 3/1963 | Henderson |
| 3,413,424 | A | | 11/1968 | Carlson |
| 3,534,183 | A | | 10/1970 | Knowles |
| 3,766,332 | A | | 10/1973 | Carlson et al. |
| 3,865,998 | A | | 2/1975 | Weiss et al. |
| 3,935,398 | A | | 1/1976 | Carlson et al. |
| 4,006,321 | A | | 2/1977 | Carlson |
| 4,272,654 | A | | 6/1981 | Carlson |
| 4,410,769 | A | | 10/1983 | Tibbetts |
| 4,739,512 | A | | 4/1988 | Hartl et al. |
| 4,870,688 | A | | 9/1989 | Voroba et al. |
| RE33,718 | E | | 10/1991 | Carlson et al. |
| 5,068,901 | A | | 11/1991 | Carlson |
| 5,193,116 | A | | 3/1993 | Mostardo |
| 5,222,050 | A | | 6/1993 | Marren et al. |
| 5,299,176 | A | | 3/1994 | Tibbetts |
| 5,548,658 | A | | 8/1996 | Ring et al. |
| 5,647,013 | A | | 7/1997 | Salvage et al. |
| 5,692,059 | A | * | 11/1997 | Kruger ..... 381/151 |
| 5,708,721 | A | | 1/1998 | Salvage et al. |
| 5,757,947 | A | | 5/1998 | Van Halteren et al. |
| 5,809,158 | A | | 9/1998 | Van Halteren et al. |
| 5,960,093 | A | | 9/1999 | Miller |
| 6,041,131 | A | | 3/2000 | Kirchhoefer et al. |
| 6,075,870 | A | | 6/2000 | Geschiere et al. |

(Continued)

FOREIGN PATENT DOCUMENTS

EP 1 469 700 A2 10/2004

(Continued)

*Primary Examiner* — Davetta W Goins
*Assistant Examiner* — Phan Le
(74) *Attorney, Agent, or Firm* — Krieg DeVault

(57) ABSTRACT

A balanced armature apparatus is disclosed that includes dual transducers for generating sound waves in response to electric audio signals. The dual transducers include a motor assembly coupled to a diaphragm. A housing defines an interior chamber and the motor assembly and the diaphragm are positioned within the interior chamber. A pair of acoustic output ports is located in a respective end of the housing. A low pass acoustic filter is in communication with one of the acoustic output ports that is operable to attenuate a predetermined range of frequencies from an audio signal produced by one of the diaphragms.

37 Claims, 7 Drawing Sheets

U.S. PATENT DOCUMENTS 6,526,153 B2 2/2003 Tibbetts et al.
6,532,293 B1 3/2003 Collins
6,654,477 B1 11/2003 Miller et al.
6,751,326 B2 6/2004 Nepomuceno
6,823,073 B2 * 11/2004 de Roo ..... 381/92
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 Van Halteren et al.
6,919,519 B2 7/2005 Ravnkilde et al.
6,930,259 B1 8/2005 Jorgensen et al.
6,931,140 B2 * 8/2005 Van Halteren et al. ..... 381/182
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,050,602 B2 5/2006 Miller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,103,196 B2 9/2006 Warren
7,110,560 B2 9/2006 Stenberg
7,136,496 B2 11/2006 Van Halteren et al.
7,142,682 B2 11/2006 Mullenborn et al.
7,164,776 B2 1/2007 Miller et al.
7,181,035 B2 2/2007 Van Halteren et al.
7,190,803 B2 3/2007 Van Halteren
7,194,102 B2 3/2007 Harvey
7,194,103 B2 3/2007 Harvey
7,203,334 B2 4/2007 Schafer et al.
7,206,428 B2 4/2007 Geschiere et al.
7,221,767 B2 5/2007 Mullenborn et al.
7,221,769 B1 5/2007 Jorgensen
7,227,968 B2 6/2007 van Halteren et al.
7,236,609 B1 6/2007 Tsangaris et al.
7,239,714 B2 7/2007 de Blok et al.
7,254,248 B2 8/2007 Johannsen et al.
7,263,195 B2 8/2007 Harvey et al.
7,286,680 B2 10/2007 Steeman et al.
7,292,700 B1 11/2007 Engbert et al.
7,292,876 B2 11/2007 Bosch et al.
7,302,748 B2 12/2007 Jiles et al.
7,627,131 B2 * 12/2009 Nielsen et al. ..... 381/328
7,844,065 B2 * 11/2010 von Dombrowski et al. . 381/328
2005/0008178 A1 1/2005 Joergensen et al.
2005/0213787 A1 9/2005 Collins
2006/0008110 A1 1/2006 van Halteren
2006/0083400 A1 4/2006 Miller et al.
2006/0098836 A1 5/2006 Sabick et al.
2006/0133636 A1 6/2006 Harvey et al.
2006/0153418 A1 7/2006 van Halteren
2006/0215874 A1 9/2006 Jiles et al.
2006/0218763 A1 10/2006 Jiles et al.
2006/0239483 A1 10/2006 Orts et al.
2006/0251279 A1 11/2006 Zei et al.
2006/0285715 A1 12/2006 Drambarean et al.
2007/0000131 A1 1/2007 Klootwijk et al.
2007/0009111 A1 1/2007 Stenberg et al.
2007/0014427 A1 1/2007 Schafer et al.
2007/0036378 A1 2/2007 Saltykov et al.
2007/0047756 A1 3/2007 Jiles et al.
2007/0053540 A1 3/2007 Harvey
2007/0058833 A1 3/2007 van Halteren et al.
2007/0121983 A1 5/2007 Jayanth et al.
2007/0133834 A1 6/2007 van Halteren
2007/0223735 A1 9/2007 LoPresti et al.
2007/0258616 A1 11/2007 Tsangaris et al.

FOREIGN PATENT DOCUMENTS

EP 1 525 775 B1 4/2006
WO WO 2005/115053 A1 12/2005
WO WO 2006/068773 A2 6/2006
WO WO 2007/018657 A2 2/2007
WO WO 2007/038671 A2 4/2007
WO WO 2007/112404 A2 10/2007

* cited by examiner

BALANCED ARMATURE WITH ACOUSTIC LOW PASS FILTER

BACKGROUND

The present invention relates to balanced armatures for playback of audio in headphones, stethoscopes, peritympanic hearing instruments or hearing aids, and headsets, and more particularly to "in ear" applications where the ear tip comes in contact with an ear canal wall.

A balanced armature is an electro-acoustic transducer which converts energy from electrical energy to acoustical energy. Balanced armatures have certain electro-acoustical limitations where nonlinearity of the flux field and armature due to saturation create distortion at the output. Mechanical compliance is also limited which can further induce distortion. Limitations also exist in the frequency bandwidth of the design. The armature has natural resonant frequencies from mass and compliance relationships that can impede smooth frequency response. Depending on the resonant frequency of the armature, the design will be deficient in the low frequency and/or high frequency region of the response.

SUMMARY

One embodiment of the present application discloses a balanced armature speaker including dual transducers and a low pass filter associated with an acoustical output. Other embodiments include unique apparatus, devices, systems, and methods of providing a balanced armature speaker that includes tuned armatures and a low pass filter. Further embodiments, forms, objects, features, advantages, aspects, and benefits of the present application shall become apparent from the detailed description and figures included herewith.

BRIEF DESCRIPTION OF THE DRAWINGS

The figures are not necessarily to scale, emphasis instead being placed upon illustrating the principles of the invention. Moreover, in the figures, like reference numerals designate corresponding parts throughout the different views.

DETAILED DESCRIPTION

Figure 1:
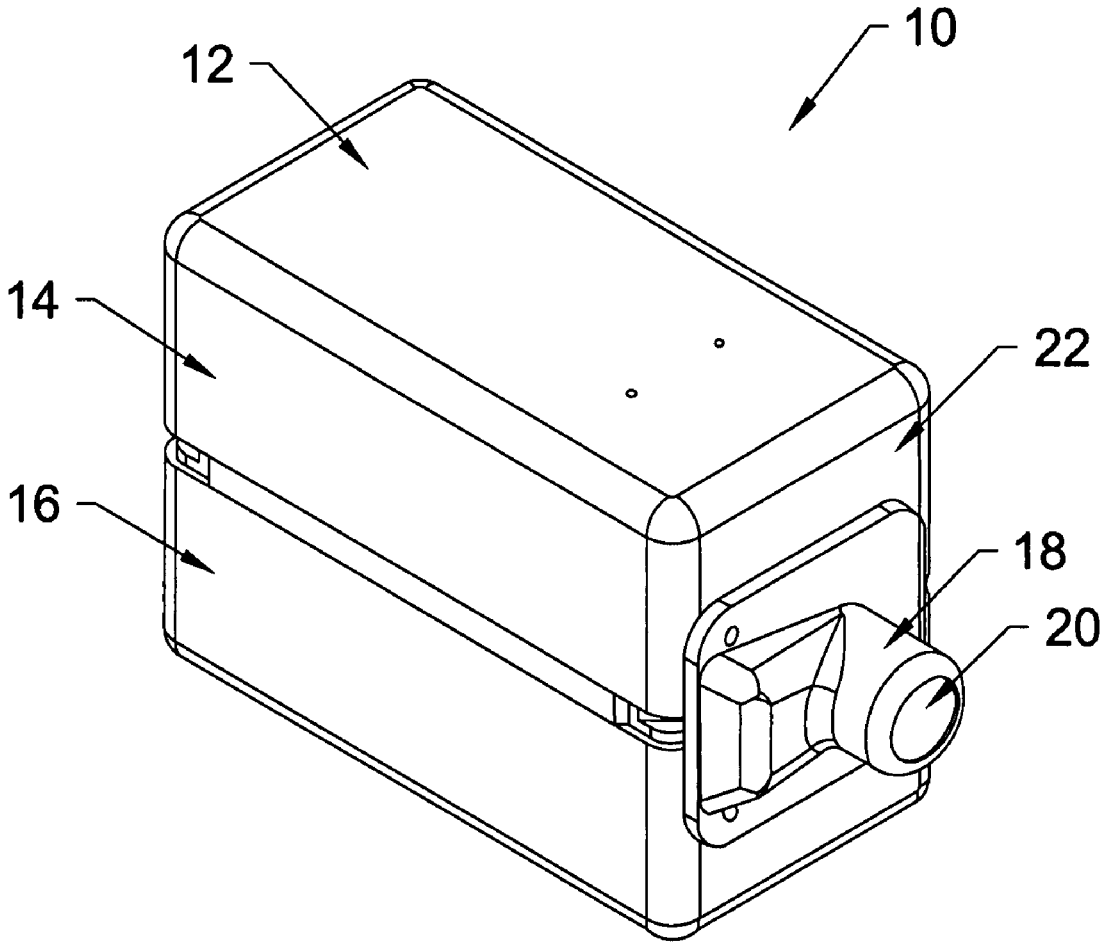
FIG. 1 is a perspective view of an illustrative balanced armature speaker.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

Referring to FIG. 1, a balanced armature speaker 10 is illustrated that is operable to convert an electrical input audio signal into an acoustic output signal. A housing 12 surrounds or houses the working components of balanced armature speaker 10 and includes a first segment or portion 14 and a second segment or portion 16. As illustrated, first portion 14 of housing 12 is connected to second portion 16 of housing 12. In one form, first portion 14 is welded to second portion 16, but alternative connection methods may be used, similar to welding. In one form, as set forth in detail below, first portion 14 houses working components operable to optimally produce sound waves falling in the mid-range and high range of the audio frequency spectrum (i.e., 300 Hz-20,000 Hz). Second portion 16 houses working components operable to optimally produce sound waves falling in the bass range of the audio frequency spectrum (i.e., 20 Hz-300 Hz).

Balanced armature speaker 10 includes a spout 18 where an acoustic output signal is broadcast from an output port 20 of spout 18. As illustrated, at least a portion of output port 20 of spout 18 comprises a tubular shaped member. As set forth in greater detail below, internal working components of balanced armature speaker 10 receive electrical audio input signals that are converted by the internal working components to an acoustic output signal that is broadcast or emitted from output port 20 of spout 18. Spout 18 is connected with a respective end 22 of housing 12. In one form, spout 18 is welded to the end 22 of housing 12, but other methods of connecting spout 18 to end 22 of housing 12 are envisioned and hereby incorporated. In another representative form, spout 18 may be formed as an integral part of housing 12.

Figure 2:
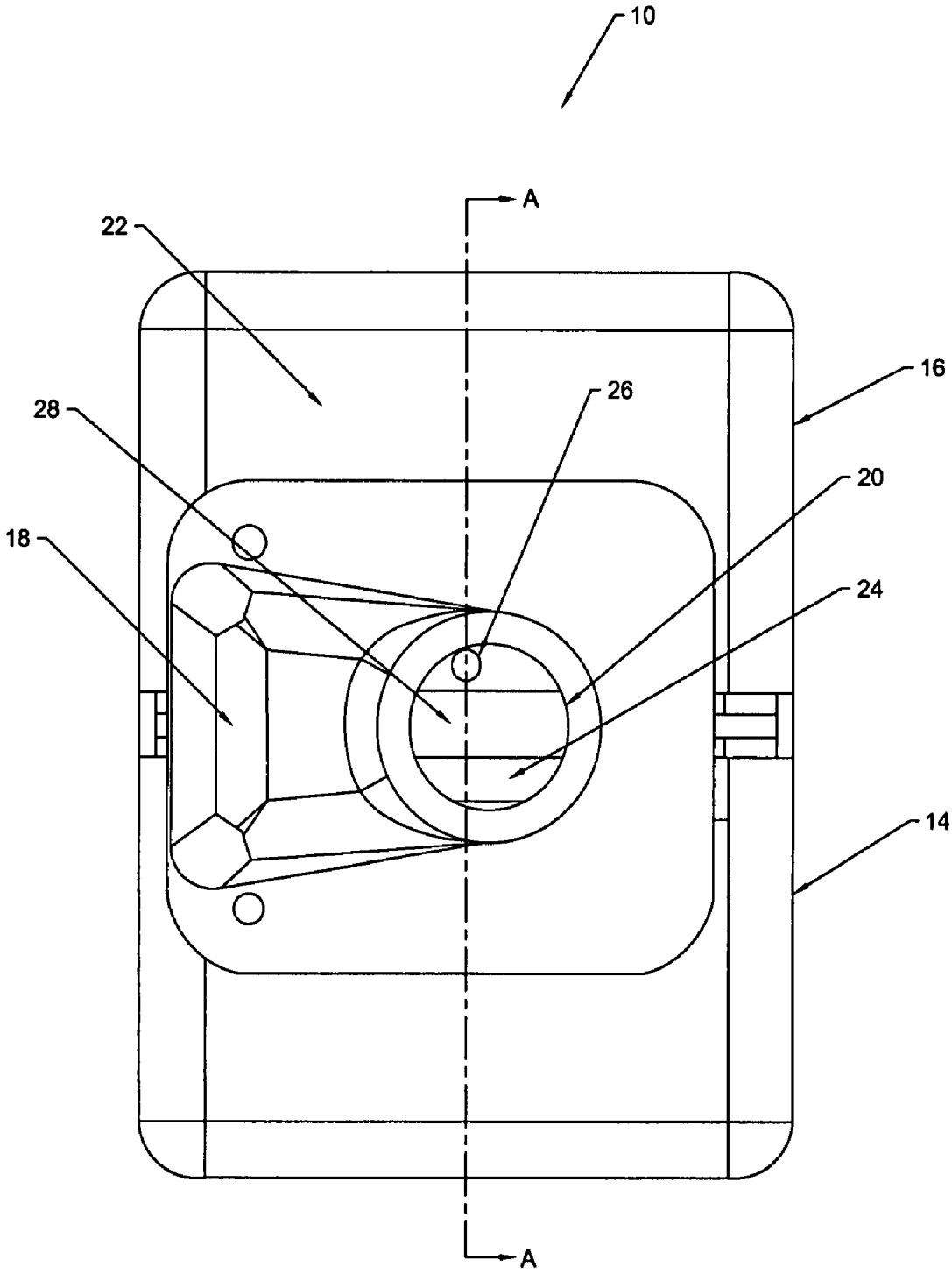
FIG. 2 is a front view of the balanced armature speaker depicted in FIG. 1.

Referring to FIG. 2, a front view of balanced armature speaker 10 illustrated in FIG. 1 is set forth. Spout 18 of balanced armature speaker 10 includes an output port 20 for broadcasting or emitting acoustic output signals or sound waves. In one form, output port 20 includes a high frequency output port 24 and a low frequency output port 26. Low frequency output port 26 comprises an acoustic low pass filter. As such, low frequency output port 26 is operable to pass certain low frequency signals but attenuate (i.e.—reduces the amplitude on signals with frequencies higher than a predetermined cutoff frequency.

Since low frequency output port 26 functions as a low pass filter, low frequency output port 26 is referred to hereinafter as low pass filter 26. As set forth above, low pass filter 26 passes low frequency signals falling within a predetermined range and attenuates or removes frequency signals falling above a predetermined threshold or cutoff frequency. As illustrated in FIG. 2, in one form low pass filter 26 comprises a generally circular shaped aperture. In one illustrative form, the generally circular shaped aperture has a predetermined diameter of about 0.2 millimeters to 0.3 millimeters.

As illustrated in FIG. 2, in one form, high frequency output port 24 comprises a generally rectangular shaped aperture or slit. A support member or barrier 28 separates low pass filter 26 from high frequency output port 24 and creates a seal between end 22 of housing 12 and spout 18. In this form, low pass filter 26 and high frequency output port 24 are located in spout 18. As such, sound waves generated from the working components contained within first portion 14 of housing 12 are broadcasted or emitted through high frequency output port 24 of spout 18. Likewise, sound waves generated from the working components contained within second portion 16 of housing 12 are broadcast or emitted through low pass filter 26.

Figure 3:
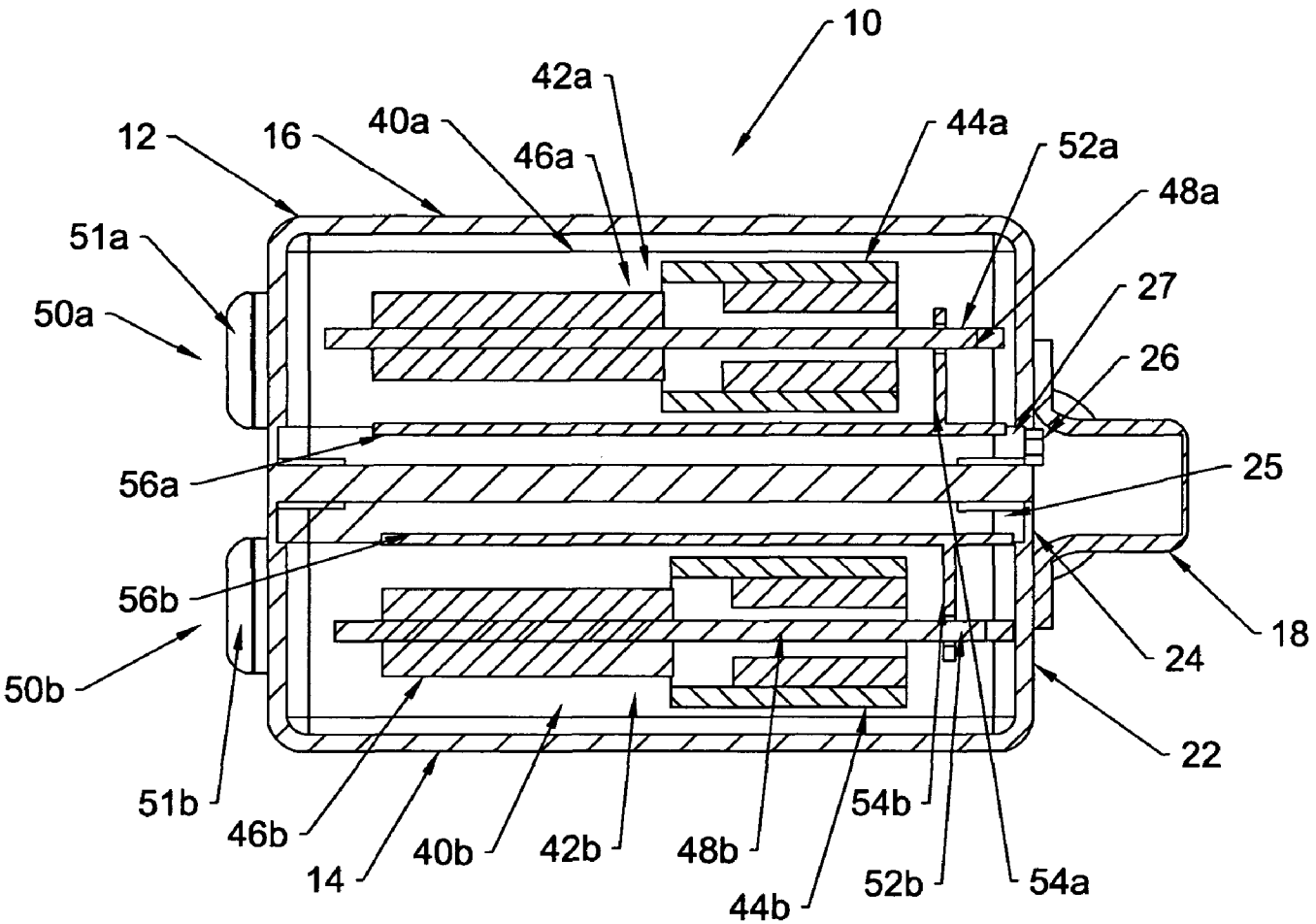
FIG. 3 is a cross-sectional view of the balanced armature speaker depicted in FIG. 2 along axis A-A.

Referring to FIG. 3, a cross-sectional view of balanced armature speaker 10 along axis A-A as depicted in FIG. 2 is illustrated. As illustrated, in this form, low pass filter 26 is formed in respective end 22 of housing 12. Low pass filter 26 is in communication with an output port 27 in housing 12. In addition, high frequency output port 24 is formed in respective end 22 of housing 12. High frequency output port 24 is in communication with a second output port 25 in housing 12. As such, low pass filter 26 and high frequency output port 24 can be formed in either spout 18 or end 22 of housing 12. In one form, low pass filter 26 has a predetermined width or depth of about 0.3 millimeters in housing 12. In addition, in one form high frequency output port 24 has a predetermined width or depth of about 2.5 millimeters in housing 12.

Balanced armature speaker 10 includes a pair of transducers 40*a*, 40*b* mounted or secured in housing 12 in a side-by-side alignment or arrangement. Transducers 40*a*, 40*b* each include a motor 42*a*, 42*b* that includes a magnet assembly 44*a*, 44*b* and a coil assembly 46*a*, 46*b* that are coaxially aligned with one another and in a generally side-by-side alignment in housing 12. Located through an axial center of each coil assembly 46*a*, 46*b* and magnet assembly 44*a*, 44*b* is a movable armature 48*a*, 48*b*. Armatures 48*a*, 48*b* are located within coil assembly 46*a*, 46*b* and magnet assembly 44*a*, 44*b* such that armatures 48*a*, 48*b* do not touch either component, thereby allow free movement of armatures 48*a*, 48*b*. Armatures 48*a*, 48*b* are moveable in response to electromagnetic forces produced by the magnet assembly 44*a*, 44*b* and coil assembly 46*a*, 46*b* in response to audio frequency electric signals applied to an electrical connector assembly 50*a*, 50*b* connected with each respective transducer 40*a*, 40*b*. It should be appreciated that each electrical connector assembly 50*a*, 50*b* includes two electrical connectors 51*a*, 51*b*. As such, first portion 14 of housing 12 includes two electrical connectors 51*b* and second portion 16 of housing 12 includes two electrical connectors 51*a*.

A respective end 52*a*, 52*b* of each armature 48*a*, 48*b* protrudes outwardly from magnet assemblies 44*a*, 44*b*. A drive pin 54*a*, 54*b* is connected with end 52*a*, 52*b* of each armature 48*a*, 48*b*. Each drive pin 54*a*, 54*b* is connected with a diaphragm or membrane 56*a*, 56*b*. As previously set forth, armatures 48*a*, 48*b* move in response to electrical audio signals received from electrical connector assemblies 50*a*, 50*b*. The corresponding movement of armatures 48*a*, 48*b* is translated into acoustic energy or sound waves by diaphragms 56*a*, 56*b*. Diaphragms 56*a*, 56*b* are mounted in a free air space in the housing 12 above magnet assembly 44*a*, 44*b* and coil assembly 46*a*, 46*b* and are operatively coupled to each respective armature 48*a*, 48*b* by drive pins 54*a*, 54*b*. Respective outer ends or edges of diaphragms 56*a*, 56*b* are connected interior portions of first portion 14 of housing 12 and second portion 16 of housing 12

In one form, the shape and configuration of armature 48*a* is optimized for the production of low or bass frequencies and armature 48*b* is optimized for the production of high and mid-range frequencies. As such, armature 48*a* is optimized for producing frequencies falling in the bass region of the audio spectrum and is associated with an output 27 in housing 12 in communication with low pass filter 26. As such, armature 48*a* is specifically tuned to a low pass frequency response. Armature 48*b* is optimized for maintaining the primary resonance of armature 48*b* for producing a broad band of frequencies falling above the bass region of the audio spectrum. Armature 48*b* is associated with an output 25 in housing 12 in communication with high frequency output port 24. In another form, armatures 48*a*, 48*b* have a similar configuration but balanced armature speaker 10 includes high frequency output port 24 and low pass filter 26.

Figure 4:
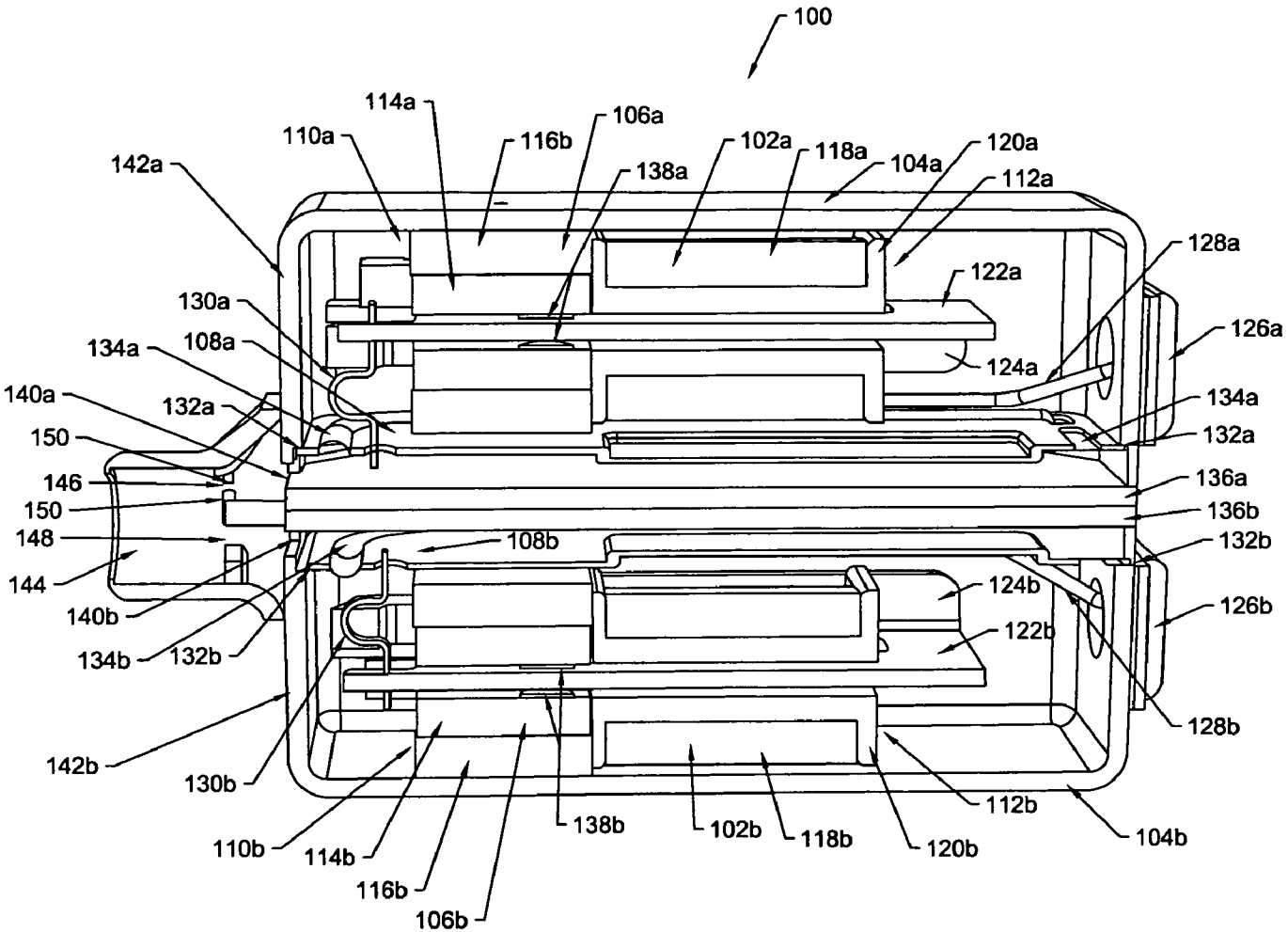
FIG. 4 is a cutaway view of another representative balanced armature speaker.

Referring to FIG. 4, a cutaway view of another representative form of a balanced armature speaker 100 is illustrated. Balanced armature speaker 100 includes a pair of transducers 102*a*, 102*b* housed within a pair of housings 104*a*, 104*b*. Each transducer 102*a*, 102*b* includes a motor 106*a*, 106*b* that is used to vibrate diaphragms or membranes 108*a*, 108*b* so that diaphragms 108*a*, 108*b* can produce sound waves. Motors 106*a*, 106*b* include a magnet assembly 110*a*, 110*b* and a coil assembly 112*a*,112*b*. Magnet assemblies 110*a*, 110*b* and coil assemblies 112*a*, 112*b* are coaxially located and in a side-by-side abutting alignment in housings 104*a*, 104*b*.

Magnet assemblies 110*a*, 110*b* include a magnet 114*a*, 114*b* that is surrounded by a magnet shell 116*a*, 116*b*. Magnet shells 116*a*, 116*b* are connected with interior surfaces of housings 104*a*, 104*b* and magnets 114*a*, 114*b* are connected with magnet shells 116*a*, 116*b*. Coil assemblies 112*a*, 112*b* include a coil winding 118*a*, 118*b* that is wrapped around a bobbin 120*a*, 120*b*. Positioned through an axial center of magnets 114*a*, 114*b* and coil windings 118*a*, 118*b* is a moveable armature 122*a*, 122*b*. Armatures 122*a*, 122*b* include a base portion 124*a*, 124*b* that is connected with a surface of housings 104*a*, 104*b*. Armatures 122*a*, 122*b* are positioned through magnets 114*a*, 114*b* and coil windings 118*a*, 118*b* such that an upper and lower gap exists between respective surfaces of magnets 114*a*, 114*b* and coil windings 118*a*, 118*b*.

A portion of bobbins 120*a*, 120*b* is connected with respective base portions 124*a*, 124*b* of armatures 122*a*, 122*b*. Base portions 124*a*, 124*b* are connected with an interior surface of housings 104*a*, 104*b*. Electrical connector assemblies 126*a*, 126*b*, which are located on an outside surface of housings 104*a*, 104*b*, are connected to coil windings 118*a*, 118*b* by a wire connection 128*a*, 128*b* running inside housings 104*a*, 104*b*. An end of armatures 122*a*, 122*b* that extend from magnet assemblies 110*a*, 110*b* include a drive pin 130*a*, 130*b* that extends upwardly and is connected with a respective end of each diaphragm 108*a*, 108*b*.

Electrical connector assemblies 126*a*, 126*b* receive respective input audio frequency electrical signals that are converted into acoustic energy in the form of sound waves by movement of armatures 122*a*, 122*b*, which thereby causes vibration of diaphragms 108*a*, 108*b*. As illustrated, outside edges of the diaphragms 108*a*, 108*b* are connected with a lip 132*a*, 132*b* extending inwardly from an inside surface of housings 104*a*, 104*b*. Diaphragms 108*a*, 108*b* may be connected with lips 132*a*, 132*b* using one of several different kinds of adhesives or some other suitable material or device. Diaphragms 108*a*, 108*b* include a flexible foil 134*a*, 134*b* that runs around portions of an outside edge of diaphragms 108*a*, 108*b*. Flexible foils 134*a*, 134*b* allow diaphragms 108*a*, 108*b* to freely move back and forth in response to movement of drive pins 130*a*, 130*b*.

As previously set forth, in response to respective audio frequency electrical signals applied to electrical connector assemblies 126*a*, 126*b*, armatures 122*a*, 122*b* move in response electromagnetic forces produced by magnet assemblies 110*a*, 110*b* and coil assemblies 112*a*, 112*b*. As such, the corresponding motion of armatures 122*a*, 122*b* is translated into acoustic energy or sound waves by diaphragms 108*a*, 108*b* which are mounted in housings 104*a*, 104*b* above magnet assemblies 110*a*, 110*b* and coil assemblies 112*a*, 112*b* and are operatively coupled with armatures 122*a*, 122*b* by drive pins 130*a*, 130*b*. Sufficient free airspace exists between diaphragms 108*a*, 108*b*, upper covers 136*a*, 136*b*, magnetic assemblies 110*a*, 110*b*, and coil assemblies 112*a*, 112*b* to permit vibration of diaphragms 108*a*, 108*b* to create acoustic energy or sound waves in response to operation of armatures 122*a*, 122*b*.

As illustrated in FIG. 4, cover 136*a* is connected with housing 104*a* and cover 136*b* is connected with housing 104*b*. Cover 136*a* is connected with cover 136*b* to form a single unitary housing. In addition, covers 136*a*, 136*b* acoustically seal first transducer 102*a* from second transducer 102*b*. As such, covers 136*a*, 136*b* act as an acoustic barrier or divider between transducers 102*a*, 102*b*. Shock plates 138*a*, 138*b* may be connected to interior surfaces of magnets 114*a*, 114*b* to prevent armatures 122*a*, 122*b* from coming into contact with magnets 114*a*, 114*b*.

In one form, acoustic output ports 140*a*, 140*b* are located in a respective end 142*a*, 142*b* of housings 104*a*, 104*b*. Acoustic energy or sound waves generated by vibration of diaphragms 108*a*, 108*b* are broadcast or emitted from acoustic output ports 140*a*, 140*b*. A spout 144 is connected with ends 142*a*, 142*b* of housings 104*a*, 104*b*. As previously set forth, spout 144 may be welded to housings 104*a*, 104*b* or connected using any other suitable connection method or device.

As indicated above with respect to the description of the embodiment set forth in FIG. 2, in one form spout 144 includes a low pass filter 146 and a high frequency output port 148. In another form, low pass filter 146 and high frequency output port 148 are positioned in respective ends 142*a*, 142*b* of housings 104*a*, 104*b*. Transducer 102*a* is optimized to produce low frequency audio outputs or sound waves and transducer 102*b* is optimized to produce high frequency audio outputs or sound waves. Spout 144 includes a constriction plate 150 that includes low pass filter 146. As previously set forth, low pass filter 146 comprises a generally circular shaped aperture.

As set forth above, the generally circular shaped aperture or low pass filter 146 is located in constriction plate 150. Low pass filter 146 is formed because the aperture increases the resistance of the air. One benefit of the present invention is improved acoustic performance in the bass region of the audio spectrum without the requirement of sacrificing high frequency integrity. As previously set forth, armature 122*a*, which can be viewed as the woofer side of balanced armature speaker 100, is tuned to a low pass frequency response.

Figure 5:
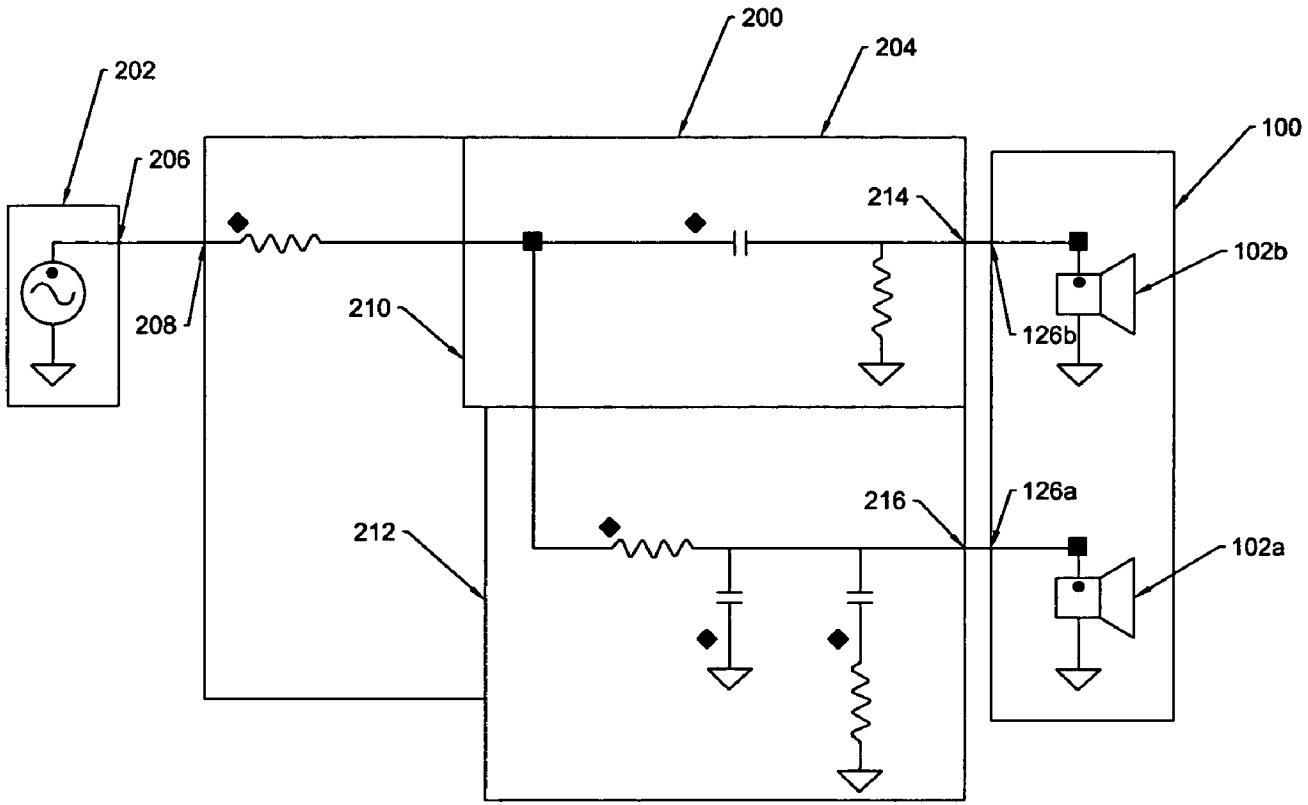
FIG. 5 illustrates an in ear audio system including a passive crossover connected with the balanced armature speaker disclosed in FIG. 4.

Referring to FIG. 5, an in ear audio system 200 is illustrated that includes balanced armature speaker 100. In ear audio system 200 includes an analog audio signal source 202 and a passive crossover 204. An output 206 of analog audio signal source 202 is connected with an input 208 of passive crossover 204. Passive crossover 204 includes a high pass filter 210 and a low pass filter 212. High pass filter 210 ignores, or passes frequencies above a predetermined frequency and attenuates, or rolls off, frequencies below the predetermined frequency. For example, in one form, high pass filter 210 is configured to pass frequencies above 300 Hz and attenuate or roll off frequencies below 300 Hz. Low pass filter 212 passes frequencies below a predetermined frequency and attenuates frequencies above it. For example, in one form, low pass filter 212 is configured to pass frequencies below 300 Hz and attenuate or rolls off frequencies above 300 Hz.

As illustrated, passive crossover 204 is configured to divide an electric audio signal that is generated by analog audio signal source 202 into two separate electric audio signals. A first electric audio signal is directed or transmitted to high pass filter 210 and a second audio signal is directed or transmitted to low pass filter 212. Once high pass filter 210 attenuates the first electric audio signal, the first electric audio signal is directed to balanced armature speaker 100. At the same time, low pass filter 212 attenuates the second electric audio signal and directs it to balanced armature speaker 100.

As illustrated, high pass filter 210 includes a high pass output 214 that is connected to electrical connector assembly 126*b* of balanced armature speaker 100. As such, the attenuated electric audio signal, having low frequencies attenuated or removed, is sent to transducer 102*b*. Low pass filter 212 includes a low pass output 216 that is connected to electrical connector assembly 126*a* of balanced armature speaker 100. The attenuated electric audio signal, having high frequencies attenuated or removed, is sent to transducer 102*a*. The use of passive crossover 200 allows balanced armature speaker 100 to further produce a better quality sound as a result of the attenuation that occurs before electric audio signals are supplied to electrical connector assemblies 126*a*, 126*b*.

Figure 6:
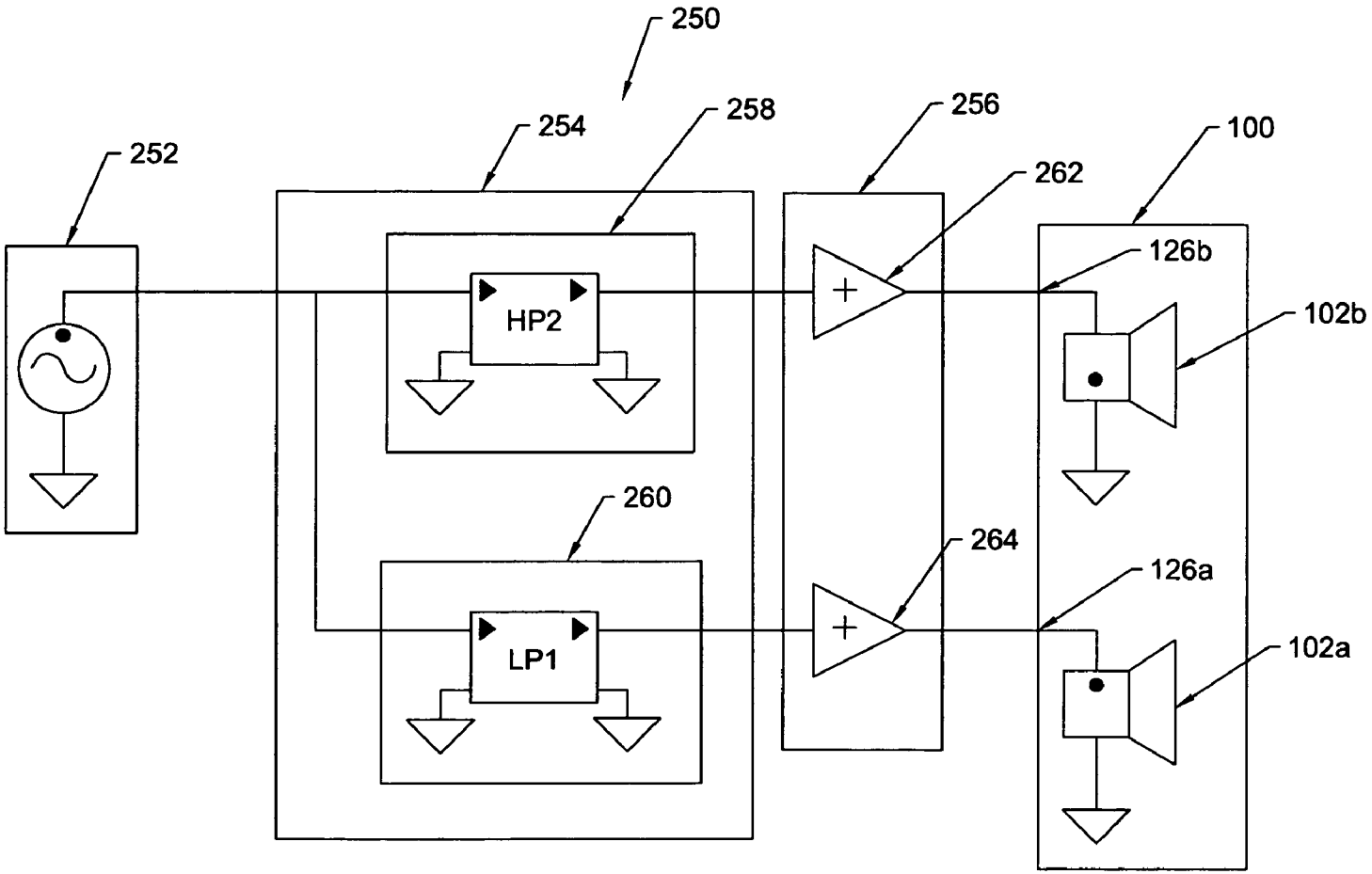
FIG. 6 illustrates an in ear audio system including an active analog crossover connected with the balanced armature speaker disclosed in FIG. 4.

Referring to FIG. 6, another representative in ear audio system 250 is illustrated that includes balanced armature speaker 100. In this form, in ear audio system 250 includes an analog audio signal source 252, an analog active crossover 254, and an amplification stage 256. An output of analog audio signal source 252 is connected with analog active crossover 254 which has outputs that are, in turn, connected with inputs of amplification stage 256. An electric audio signal output of analog audio signal source 252 is communicated to analog active crossover 254. The output of amplification stage 256 is connected directly to the balanced armature speaker 100. Amplification stage 256 presents the maximum damping factor at all times, regardless of frequency, and is not affected by active crossover 254, since that is also active, and located before amplification stage 256.

As illustrated, analog audio signal output from source 252 is provided to active crossover 254. The electric audio signal output is provided as an input to a high pass filter circuit 258 and a low pass filter circuit 260. High pass filter circuit 258 is designed and configured to attenuate or roll off frequencies below a predetermined threshold (e.g. –300 Hz). Low pass filter circuit 260 attenuates or rolls off frequencies above a predetermined threshold (e.g. –300 Hz).

A first electric audio signal output, that has been filtered by high pass filter 258, is supplied to a first amplifier 262 of amplification stage 256. A second electric audio signal output, that has been filtered by low pass filter 260, is supplied to a second amplifier 264 of amplification stage 256. A first amplified electric audio signal is supplied, via electrical connector assembly 126*b*, from an output of first amplifier 262 to transducer 102*b* of balanced armature speaker 100. A second amplified electric audio signal is supplied, via electrical connector assembly 126*a*, from an output of second amplifier 264 to transducer 102*a* of balanced armature speaker 100.

Figure 7:
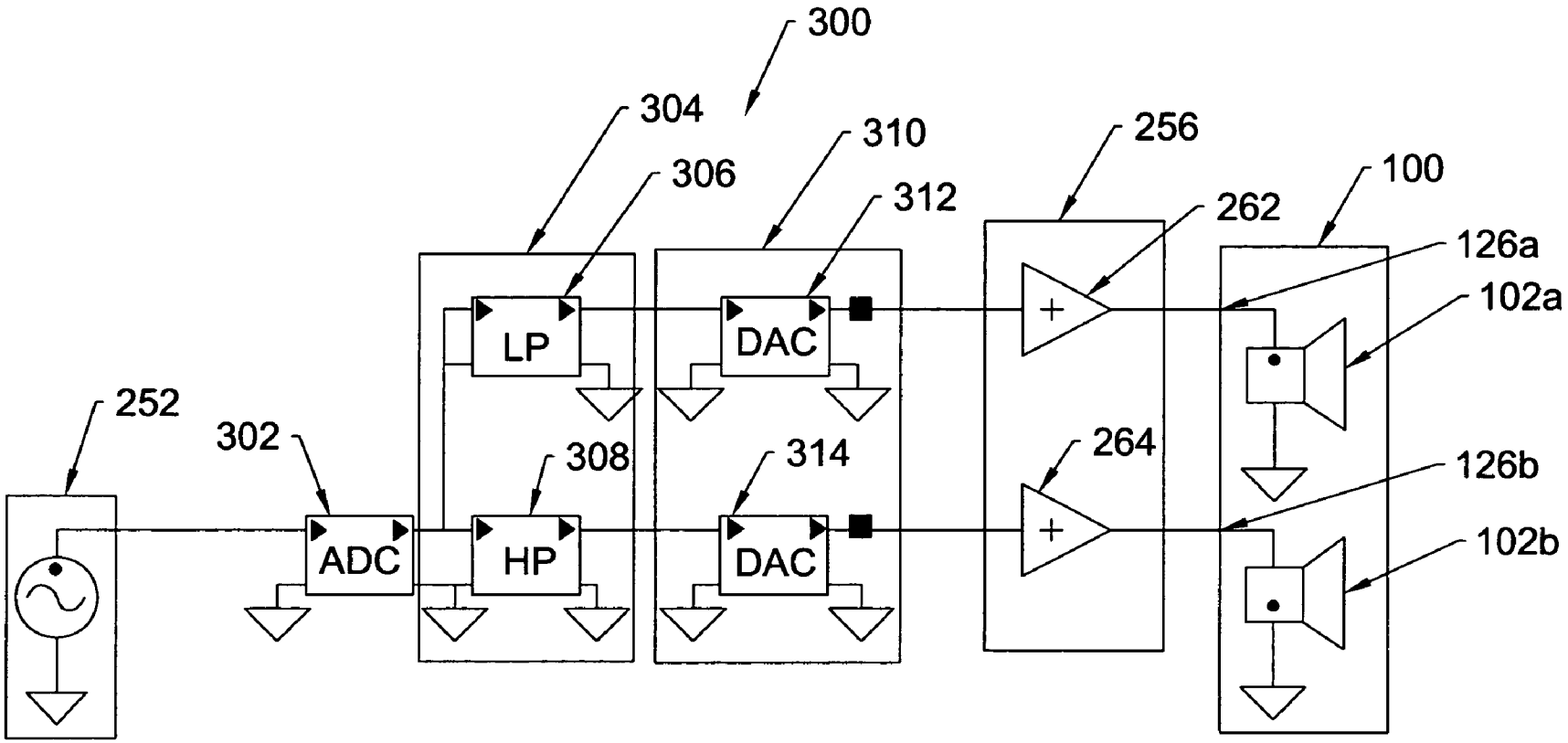
FIG. 7 illustrates an in ear audio system including an active digital crossover connected with the balanced armature speaker disclosed in FIG. 4.

Referring to FIG. 7, yet another in ear audio system 300 is illustrated that includes balanced armature speaker 100. As with the previous form set forth in FIG. 6, this system 300 also includes an analog audio signal source 252. Source 252 is connected with an analog to digital converter 302 that converts the analog audio signal provided by source 252 into a digital audio signal. The digital audio signal is then communicated to a digital active crossover 304. In one form, digital active crossover 304 comprises a finite impulse response ("FIR") crossover and in another representative form digital active crossover 304 comprises an infinite impulse response ("IIR") crossover.

Digital active crossover 304 divides the digital audio signal into two signals that are supplied as inputs to a digital low pass filter 306 and a digital high pass filter 308. Digital low pass filter 306 attenuates or removes frequencies falling above a predetermined threshold and digital high pass filter 308 attenuates or removes frequencies falling below a predetermined threshold. The outputs of digital low pass filter 306 and digital high pass filter 308 are supplied as inputs to a digital to analog conversion stage 310 that includes a first and second digital to analog converter 312, 314.

First digital to analog converter 312 converts filtered digital audio signals that are generated by digital low pass filter 306 into filtered analog audio signals. Second digital to analog converter 314 converts filtered digital audio signals that are generated by digital high pass filter 308 into filtered analog audio signals. These respective filtered analog audio signals are supplied as inputs to amplifiers 262, 264 of amplification stage 256. As with the previous form illustrated in FIG. 6, amplified analog audio output signals from amplifiers 262, 264 are supplied to transducers 102*a*, 102*b* of balanced armature speaker 100.

One form of the present invention discloses an apparatus that includes a motor assembly coupled to a diaphragm. The apparatus also includes a housing defining an interior chamber. The motor assembly and the diaphragm are positioned within the interior chamber. An acoustic output port is located in a respective end of the housing. A low pass acoustic filter is in communication with the acoustic output port that is operable to attenuate a predetermined range of frequencies from an audio signal or sound wave produced by the diaphragm.

Another from of the present invention discloses a balanced armature speaker comprising a motor comprising a coil and a magnet assembly; an armature extending through the coil and the magnet assembly; a drive pin having one end coupled to the armature and a second end coupled to a membrane; a housing containing the motor, the armature, the drive pin and the membrane; and a spout coupled to a respective end of the housing including a low pass filter.

In yet another form, an apparatus is disclosed comprising a first transducer positioned in a housing; a second transducer positioned in the housing such that the first and second transducers are oriented in a side-by-side relation in the housing; a dividing member separating the first and second transducers such that the first and second transducers are substantially isolated from one another; a spout connected to a respective end of the housing; a first output port in the housing for directing sound waves generated by the first transducer through an output of the spout; and a second output port in the housing for directing sound waves generated by the second transducer through a low pass filter and then out of the spout.

Another embodiment discloses a method comprising generating sound waves from a first transducer positioned in a housing; generating sound waves from a second transducer positioned in the housing; directing the sound waves generated by the first transducer to an output port located in a spout; and directing the sounds waves generated by the second transducer to a low pass filter located in the spout.

A further aspect of the present invention discloses an apparatus comprising a housing; a first motor assembly coupled to a first diaphragm positioned in a first side of the housing; a second motor assembly coupled to a second diaphragm positioned in a second side of the housing; a cover separating the first motor assembly and the first diaphragm from the second motor assembly and the second diaphragm; a first acoustic output port located in the housing for directing sound waves generated from operation of the first diaphragm out of the housing; a second acoustic output port located in the housing for directing sound waves generated from operation of the second diaphragm out of the housing; and a filter in communication with the first acoustic output port for attenuating a predetermined range of frequencies from the sound waves generated by operation of the first diaphragm.

Another aspect of the present invention discloses an in ear audio system comprising an electric audio signal source for producing an electric audio signal; a crossover connected with the electric audio signal source including a low pass filter and a high pass filter; a balanced armature speaker connected with a first output of the low pass filter and a second output from the high pass filter; and wherein the balanced armature speaker includes a motor assembly coupled to a diaphragm; a housing defining an interior chamber, wherein the motor assembly and the diaphragm are positioned within the interior chamber; an acoustic output port located in a respective end of the housing; and a low pass acoustic filter in communication with the acoustic output port operable to attenuate a predetermined range of frequencies from an audio signal produced by the diaphragm.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a motor assembly coupled to a diaphragm;

a housing defining an interior chamber, wherein said motor assembly and said diaphragm are positioned within said interior chamber;

an acoustic output port located in a respective end of said housing; and a low pass acoustic filter in communication with said acoustic output port operable to attenuate a predetermined range of frequencies from an audio signal produced by said diaphragm, wherein said low pass acoustic filter comprises an aperture formed as part of said housing.

2. The apparatus of claim 1, wherein said aperture comprises a generally circular shaped aperture having a predetermined width and diameter.

3. The apparatus of claim 1, further comprising a spout connected with an outside surface of said housing.

4. A balanced armature speaker, comprising:

a motor comprising a coil and a magnet assembly;

an armature extending through said coil and said magnet assembly;

a drive pin having one end coupled to said armature and a second end coupled to a membrane;

a housing containing said motor, said armature, said drive pin and said membrane; and a spout coupled to a respective end of said housing including a low pass filter formed as an integral part of said spout.

5. The balanced armature speaker of claim 4, wherein said low pass filter comprises a generally circular shaped aperture aligned with an acoustic output port of said housing.

6. The apparatus of claim 4, further comprising a second motor comprising a second coil and a second magnet assembly; a second armature extending through said second coil and said second magnet assembly; a second drive pin having one end coupled to said second armature and another end coupled to a second membrane; and wherein said second motor, said second armature, said second drive pin, and said second membrane are positioned within said housing.

7. The apparatus of claim 6, wherein said housing includes a first acoustic opening in communication with said low pass acoustic filter and a second acoustic opening sealed apart from said first acoustic opening that is in communication with an acoustic output port of said spout.

8. The apparatus of claim 4, wherein said low pass filter comprises an aperture in said spout.

9. The apparatus of claim 8, wherein said aperture comprises a generally circular shaped aperture having a predetermined width and diameter.

10. The apparatus of claim 4, wherein said armature is tuned to a low pass frequency response.

11. The apparatus of claim 6, wherein said armature is tuned to a low pass frequency response and said second armature is tuned to a high pass frequency response.

12. An apparatus, comprising:

a first transducer positioned in a housing;

a second transducer positioned in said housing such that said first and second transducers are oriented in a side-by-side relation in said housing;

a dividing member separating said first and second transducers such that said first and second transducers are substantially isolated from one another;

a spout connected to a respective end of said housing;

a first output port in said housing for directing sound waves generated by said first transducer through an output of said spout; and a second output port in said housing for directing sound waves generated by said second transducer through a low pass filter and then out of said spout.

13. The apparatus of claim 12, wherein said first and second transducers comprise a motor having a coil and a magnet assembly; an armature extending through said coil and said magnet assembly; and a drive pin having one end coupled to said armature and a second end coupled to a membrane.

14. The apparatus of claim 13, wherein said armature associated with said second transducer is tuned to a low pass frequency response.

15. The apparatus of claim 14, wherein said armature associated with said first transducer is tuned to a high pass frequency response.

16. The apparatus of claim 12, wherein said first transducer is tuned to a high frequency response and said second transducer is tuned to a low frequency response.

17. The apparatus of claim 12, wherein said low pass filter comprises an aperture in said spout apart from said output of said spout.

18. A method, comprising:

generating sound waves from a first transducer positioned in a housing;

generating sound waves from a second transducer positioned in said housing;

directing said sound waves generated by said first transducer to an output port located in a spout; and directing said sounds waves generated by said second transducer to a low pass filter located in said spout, wherein said low pass filter is formed as an integral part of said spout and sound waves directed to said low pass filter are isolated from sound waves generated by said first transducer.

19. The method of claim 18, wherein said first and second transducers comprise a motor having a coil and a magnet assembly; an armature extending through said coil and said magnet assembly; and a drive pin having one end coupled to said armature and a second end coupled to a membrane.

20. The method of claim 19, where said armature of said first transducer is tuned to a high frequency response.

21. The method of claim 19, wherein said armature of said second transducer is tuned to a low frequency response.

22. The method of claim 18, wherein said first transducer is tuned to a high frequency response and said second transducer is tuned to a low frequency response.

23. An apparatus, comprising:

a housing;

a first motor assembly coupled to a first diaphragm positioned in a first side of said housing;

a second motor assembly coupled to a second diaphragm positioned in a second side of said housing;

a cover separating said first motor assembly and said first diaphragm from said second motor assembly and said second diaphragm thereby isolating said first motor assembly from said second motor assembly;

a first acoustic output port located in said housing for directing sound waves generated from operation of said first diaphragm out of said housing;

a second acoustic output port located in said housing for directing sound waves generated from operation of said second diaphragm out of said housing; and a filter in communication with said first acoustic output port for attenuating a predetermined range of frequencies from said sound waves generated by operation of said first diaphragm.

24. The apparatus of claim 23, further comprising a spout connected with said housing.

25. The apparatus of claim 24, wherein said filter is located in said spout.

26. The apparatus of claim 25, wherein said acoustic low pass filter comprises a generally circular shaped aperture.

27. The apparatus of claim 23, wherein said first motor assembly includes an armature tuned to a low pass frequency response.

28. The apparatus of claim 27, wherein said second motor assembly includes a second armature tuned to a high pass frequency response.

29. The apparatus of claim 27, wherein said low pass frequency response ranges from about 20 Hertz to 300 Hertz.

30. The apparatus of claim 28, wherein said high pass frequency response ranges from about 300 Hertz to 20,000 Hertz.

31. An in ear audio system, comprising:

an electric audio signal source for producing an electric audio signal;

a crossover connected with said electric audio signal source including a low pass filter and a high pass filter;

a balanced armature speaker connected with a first output of said low pass filter and a second output from said high pass filter; and wherein said balanced armature speaker includes a motor assembly coupled to a diaphragm; a housing defining an interior chamber, wherein said motor assembly and said diaphragm are positioned within said interior chamber; an acoustic output port located in a respective end of said housing; and a low pass acoustic filter in communication with said acoustic output port operable to attenuate a predetermined range of frequencies from an audio signal produced by said diaphragm.

32. The system of claim 31, wherein said crossover comprises an passive crossover.

33. The system of claim 31, wherein said crossover comprises an active analog crossover.

34. The system of claim 32, wherein said crossover comprises an active digital crossover.

35. The system of claim 34, wherein said active digital crossover comprises a finite impulse response crossover.

36. The system of claim 34, wherein said active digital crossover comprises a infinite impulse response crossover.

37. The system of claim 31, wherein said low pass acoustic filter comprises an aperture formed in said housing.

* * * * *